US005738290A

United States Patent [19]

Straaten et al.

[11] Patent Number: 5,738,290

[45] Date of Patent: Apr. 14, 1998

[54] YARN POSITIONING MECHANISM OF AN AUTOMATIC TRAVELING PACKAGE DOFFER

[75] Inventors: Paul Straaten, Kerken; Ulrich Fechter; Jürgen Enger, both of Mönchengladbach; Norbert Corres, Wegberg, all of Germany

[73] Assignee: W. Schlafhorst AG & Co., Monchen-Gladbach, Germany

[21] Appl. No.: 713,793

[22] Filed: Sep. 13, 1996

[30] Foreign Application Priority Data

Sep. 13, 1995 [DE] Germany ..... 195 33 833.2

[51] Int. Cl.[6] ..... B65H 54/00; B65H 54/02

[52] U.S. Cl. ..... 242/18 PW; 242/35.5 A

[58] Field of Search ..... 242/35.5 A, 18 PW

[56] References Cited

U.S. PATENT DOCUMENTS

| | | | |
|---|---|---|---|
| 3,971,520 | 7/1976 | Shimai | 242/35.5 A |
| 4,550,880 | 11/1985 | Niederer | 242/18 PW |
| 4,565,331 | 1/1986 | Matsubara et al. | 242/35.5 A X |
| 5,016,829 | 5/1991 | Schippers et al. | 242/18 PW X |
| 5,150,845 | 9/1992 | Colli et al. | 242/18 PW X |
| 5,246,178 | 9/1993 | Badiali et al. | 242/35.5 A X |
| 5,299,750 | 4/1994 | Nakagawa et al. | 242/35.5 A |

FOREIGN PATENT DOCUMENTS

| | | |
|---|---|---|
| 0 282 105 B1 | 1/1992 | European Pat. Off. . |
| 26 15 909 C2 | 10/1989 | Germany . |
| 40 01 253 A1 | 7/1991 | Germany . |
| 42 17 575 A1 | 12/1992 | Germany . |
| 40 40 552 C2 | 1/1993 | Germany . |

OTHER PUBLICATIONS

"Der Kreuzspulenwechsler", Schlafhorst, Inc. Autoconer 238 manual, pp. 1.7, 1.7.6, 1.7.7, 1.7.10, 1.7.10(2),1.7.11, and 1.7.11(2).

*Primary Examiner*—Michael Mansen

*Attorney, Agent, or Firm*—Kennedy Covington Lobdell & Hickman, LLP

[57] ABSTRACT

An automatic package doffer of a textile winding machine includes a yarn engaging device and a travel limiting device. The yarn engaging device includes a pivot housing and a movably hinged yarn lifter head and is seated on a pivot and bearing shaft in a partially rotatable and axially displaceable disposition. A yarn catcher plate, clamping shears, and a yarn guide plate are disposed on the yarn lifter head. The yarn engaging device also includes a stop element for engaging the housing of a respective winding station for stopping movement of the yarn engaging device at a first predefined position with respect to the winding station housing. The travel limiting device includes a clamp assembly that is clampable to the yarn engaging device when at the first predefined position and guide rails attached to the doffer upon which the clamp assembly is slidably disposed. A pneumatic cylinder selectively causes the clamp assembly to clamp onto a braking tube that is part of the yarn engaging device. Another stop element disposed on the doffer limits travel of the clamp assembly and the clamped yarn engaging device at a second predefined position whereat a yarn supply is positioned against an empty tube. Thus, it possible to repeatedly place a yarn end of a supply yarn against an empty tube held in the winding frame at a precise and accurate position without elaborate adjusting steps being required at the winding station or on the doffer.

10 Claims, 9 Drawing Sheets

YARN POSITIONING MECHANISM OF AN AUTOMATIC TRAVELING PACKAGE DOFFER

FIELD OF THE INVENTION

The invention relates to an automatic traveling package doffer of a yarn processing machine and, more particularly, to an automatic traveling package doffer that has a device for exchanging full yarn packages for empty tubes and that positions the supply yarn on the empty tube for winding thereon.

BACKGROUND OF THE INVENTION

An automatic traveling yarn package doffer is known from many publications, like, for example, the "Autoconer 238" manual of W. Schlafhorst A. G. & Co. of M önchengladbach, Germany, and from German Patent Publication DE 42 17 575 A1. A conventional doffer having various yarn manipulating elements which travels along the winding stations of a textile winder is shown on page 01.7.0 of the manual "Autoconer 238," and explained in more detail on the following pages.

It is known that such a conventional doffer moves back and forth on the superstructure of a textile winder above the winding stations and automatically exchanges each full yarn package, which has reached its predetermined length or predetermined diameter, for an empty tube. The doffer places the full yarn package on a depository disposed behind the winding stations, or on a conveyor belt disposed adjacent the winding station, and subsequently takes an empty tube from a tube magazine disposed above the winding stations and places the tube for resumption of winding of the supply yarn.

The traversing yarn extending between the delivery spool and the yarn package must be cut and the end of the yarn supply retained for placement on the empty tube in the process. Conventionally, the doffer includes a yarn lifter head having a catcher plate for engagement of the traversing yarn. The yarn lifter head is pivotable so that the catcher plate comes into the area of the traversing yarn to intercept the yarn, and a separately disposed transfer device picks up the yarn caught by the catcher plate and transports the yarn to shears which cut the yarn to create a top yarn and a bottom yarn. The top yarn is then aspirated into a top nozzle and subsequently is wound as the top winding on the tube end of the full yarn package. A telescopically extendible bottom nozzle grips the bottom yarn end of the supply yarn and winds it in a special reserve winding mechanism as the initial winding on an empty tube. The tube prepared in this manner is subsequently transferred into the winding frame and the winding process is started to produce another yarn package.

As the above description reveals, the yarn package doffing process is somewhat complicated and the required doffer is relatively elaborate. A doffer which is similar in principle is known from DE 42 17 575 A1 and has a yarn lifter that is double-jointed.

A doffer is furthermore known from European Patent Publication EP 0 282 105 B1, which first transfers the full yarn package to be changed from the winding frame to a delivery chute. With a hook-shaped end element, a manipulating arm, which is pivotable in two planes orthogonally arranged in respect to each other, subsequently grabs the yarn, which is fixed in a recess of the delivery chute and clamped between the yarn guide drum and the package, and brings it into the area of the tube receptacle of the winding frame where it is clamped by an inserted empty tube and cut by a cutting device disposed on the manipulating arm.

OBJECT AND SUMMARY OF THE INVENTION

In view of the doffing machines described above, it is an object of the present invention to improve and simplify doffing and restarting operations of a yarn processing machine. This object is achieved in accordance with the present invention by an automatic traveling package doffer that travels along the stations of a yarn processing machine, doffs full wound packages, places empty tubes for winding yarn thereon, and positions a supply yarn on the empty tube for winding thereon, and which includes a yarn positioning mechanism for positioning of the supply yarn on the empty tube for winding of a yarn package.

The yarn positioning mechanism of the present invention includes a yarn engaging device that is movably mounted on the doffer for movement in opposite directions parallel to the travel path of the doffer. The yarn engaging device is furthermore engageable with the end of a supply yarn for positioning the yarn on an empty tube. A travel limiting device is mounted on the doffer and includes a clamp assembly movable in the directions parallel to the travel path and clampable to the yarn engaging device when said yarn engaging device is at a first predefined position with respect to the respective station. A first stop element is attached to the doffer for engagement of the clamping assembly of the travel limiting device upon movement of the clamp assembly and the clamped yarn engaging device in a first one of the directions for stopping movement of the clamp assembly and the clamped yarn engaging device at a second predefined position with respect to the station for precise positioning of the supply yarn for producing a reserve winding on the empty tube.

It is a further feature of the present invention to include a second stop element disposed on the yarn engaging device for engagement with the respective station during movement of the yarn engaging device in a second one of the directions opposite to the first direction for stopping movement of the yarn engaging device at the first predefined position for clamping by the clamp assembly.

It is yet a further feature of the present invention to include a sensor disposed on the doffer for monitoring the proper positioning of the travel limiting device at the second position. Preferably a Hall sensor is disposed on the doffer for the detection of the travel limiting device at the second predefined position.

In yet a further feature of the present invention, the yarn positioning mechanism includes a pivot and bearing shaft. Moreover, the yarn engaging device preferably includes a yarn lifter head pivotable toward and away from the respective station and a toothed belt drive connected to the yarn lifter head for controlling pivotable movement of the yarn lifter head. The toothed belt drive is also preferably connected to the pivot and bearing shaft by a force transfer mechanism that is axially displaceable on the pivot and beating shaft for pivoting the yarn lifter head when the pivot and bearing shaft rotates. The yarn lifter head also preferably includes a yarn catcher plate and clamping shears. The yarn catcher plate preferably has yarn catching contours disposed on opposite sides thereof for receiving the yarn, and the clamping shears preferably is displaceably disposed on the yarn lifter head for selective positioning along the yarn lifter head. The yarn lifter head is furthermore selectively stoppable with respect to the pivoting angle to the station housing.

The traveling limiting device of the present invention preferably includes sliding guide rails fixedly attached to the doffer. The clamp assembly is preferably slidably disposed on the guide rails, and springs are preferably disposed on the guide rails for the positioning of the clamp assembly at an initial position with respect to the doffer for clamping to the yarn engaging device.

The yarn engaging device preferably includes a braking tube and the clamp assembly preferably includes a pivotable clamping arm within which the braking tube extends when the yarn engaging device is at the first predefined position. The clamp assembly also includes a cylinder for actuation of the clamping arm for engagement thereof with the braking tube.

DETAILED DESCRIPTION OF THE PREFERRED EMBODIMENT

Figure 1:
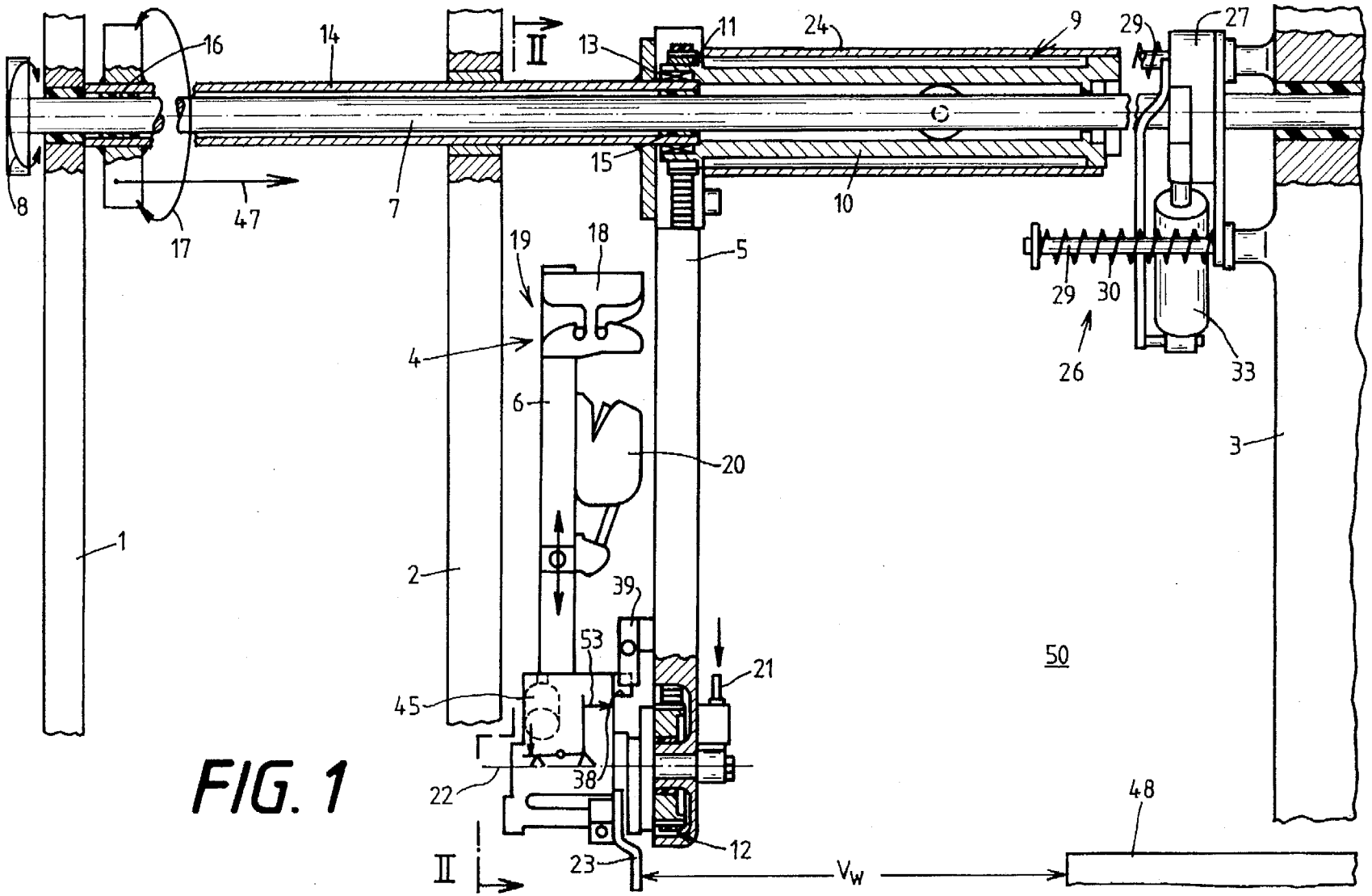
FIG. 1 is a front view partially in section of the yarn positioning mechanism of an automatic yarn package doffer according to the preferred embodiment of the present invention.

The preferred doffer 50 of the present invention is used in conjunction with a textile winder having a plurality of winding stations. Housing wall elements 1,2,3 of the automatic package doffer 50 (not shown in detail) are shown in FIG. 1. Such a doffer has a plurality of different yarn manipulating elements. For the sake of clarity, however, only the yarn engaging device 4 with the travel limiting device 26 in accordance with the present invention is illustrated in the Figures with other elements of the doffer having been omitted as will be apparent to one of ordinary skill in the art.

Figure 2:
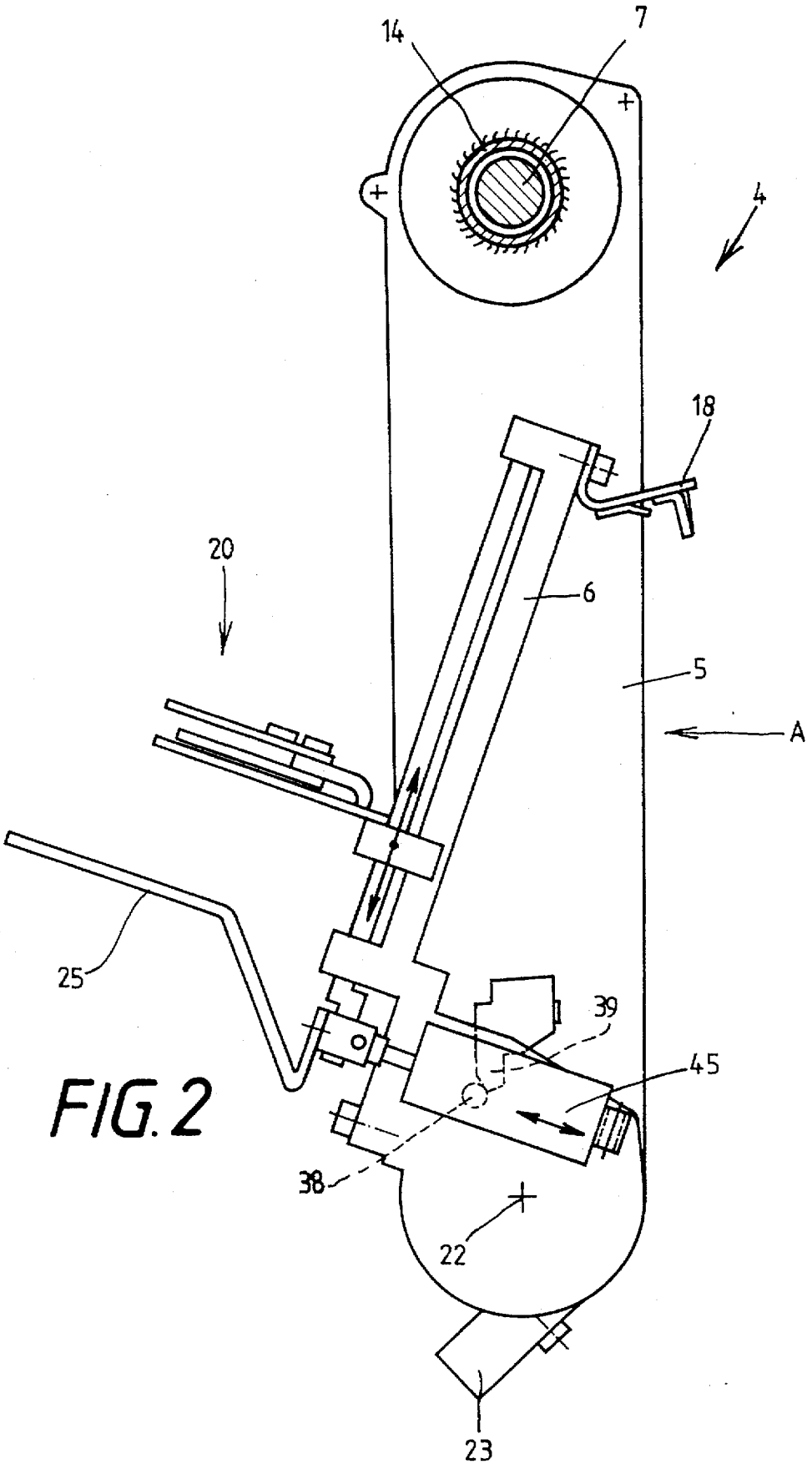
FIG. 2 is a side view of the yarn positioning mechanism of FIG. 1, taken along line II—II in FIG. 1.

The yarn engaging device 4 essentially consists of a pivot housing 5 and a yarn lifter head 6. A yarn catcher plate 18 is disposed on the end of the yarn lifter head 6 and includes yarn catching contours 19 that are open on both sides in the shape of a funnel. Clamping shears 20 are also disposed on the yarn lifter head 6 and comprise yarn shears and a yarn clamp, and the clamping shears 20 are adjustably disposed along the yarn lifter head 6 as illustrated by the arrows in FIG. 2. The clamping shears 20 are preferably controllable by means of a pneumatic cylinder 45 which is connected with a pressure source via a feed line 21. A yarn guide plate 25 and an adjustable stop 23 are also preferably disposed in the area of the pivot shaft 22 of the yarn lifter head 6 as illustrated in FIG. 2. The stop 23 is engageable with the housings 48 of the winding stations at a first predefined location with respect to each winding station housing 48 during axial displacement of the yarn engaging device 4 in a first direction X illustrated in FIG. 3 parallel to the travel path of the doffer. A stop element 38 is furthermore provided on the yarn lifter head 6 in the area of the pivot shaft 22. The pivot housing 5 preferably includes a stop element 39 for engagement with the stop element 38 when the yarn lifter head 6 is in an initial position, as described in greater detail below.

The yarn engaging device also preferably includes a pneumatic cylinder 45 which selectively moves the clamping shears 20 along the yarn lifter head 6 as well as actuates the cutting and clamping action of the clamping shears 20. A stop element 53 is also actuatable by the pneumatic cylinder 45 for selective stopping movement of the yarn lifter head 6 as described in greater detail below and illustrated in FIG. 9.

The yarn engaging device 4 is seated partially pivotable and axially displaceable on a pivot and beating shaft 7 by means of its pivot housing 5. The pivot and bearing shaft 7 can be acted upon in a defined manner, for example by means of a conventional cam disk drive 8 (not shown in detail), and is connected via an axially displaceable force transfer device 9 with a bearing sleeve 10 which in turn has a pinion 11 of a toothed belt drive 12. The bearing sleeve 10 is supported via a bearing arrangement 13 on a rotating sleeve 14 and is furthermore enclosed in a braking tube 24.

The rotating sleeve 14, which is seated partially rotatable by means of bearings 15, 16 on the pivot and bearing shaft 7, is connected on the one side, secure against relative rotation, with the pivot housing 5 of the yarn engaging device 4, and on the other side is connected with a conventional cam disk drive 17. In addition, a conventional drive mechanism (not shown) is disposed in the area of the cam disk drive 17 and allows an axial displacement of the rotating sleeve 14 back and forth along the direction of arrow 47, and thus causes the same axial displacement of the yarn engaging device 4.

Figure 3:
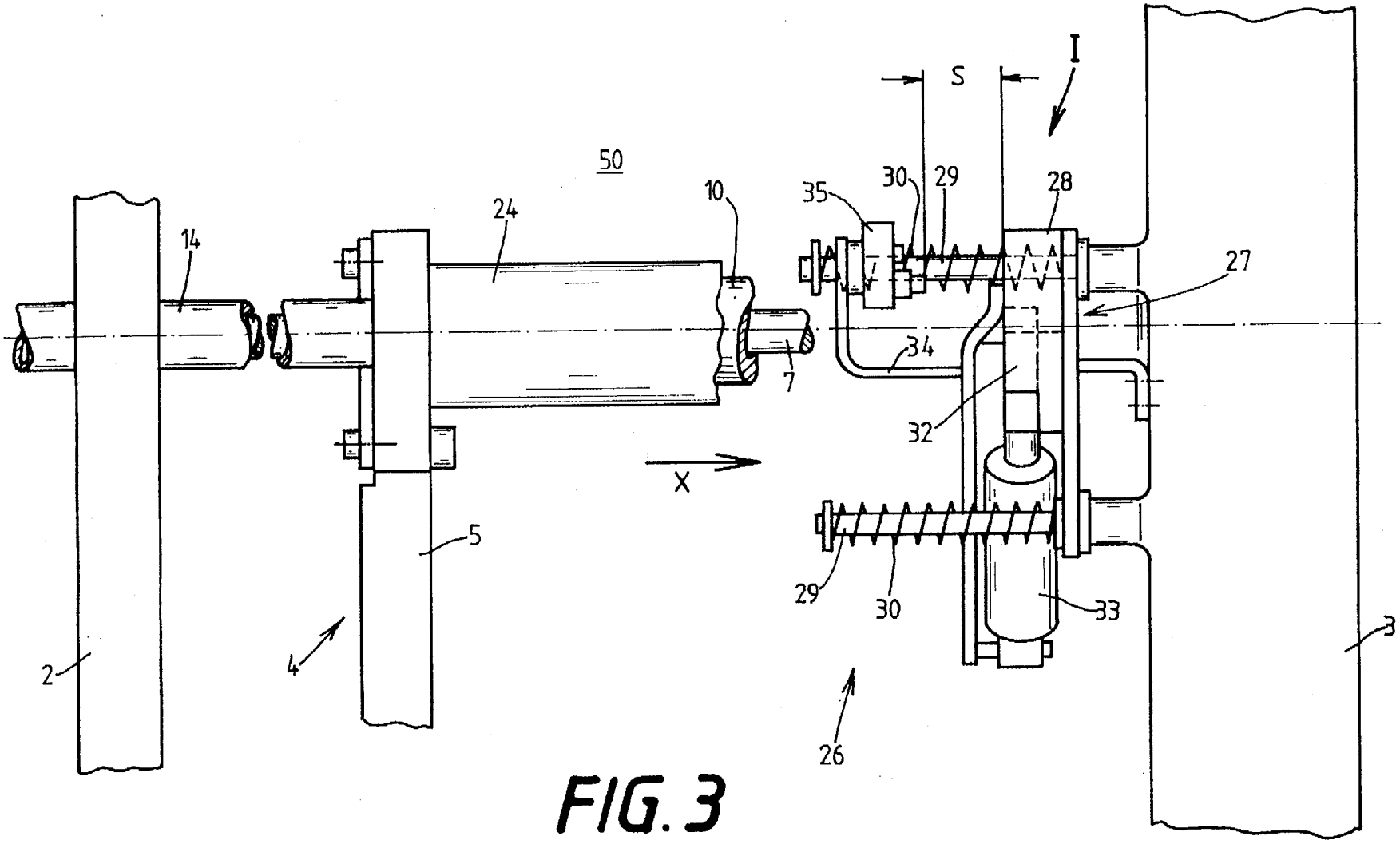
FIG. 3 is a front view, partially in section, of the travel limiting device of the yarn positioning mechanism shown in FIG. 1.
Figure 4:
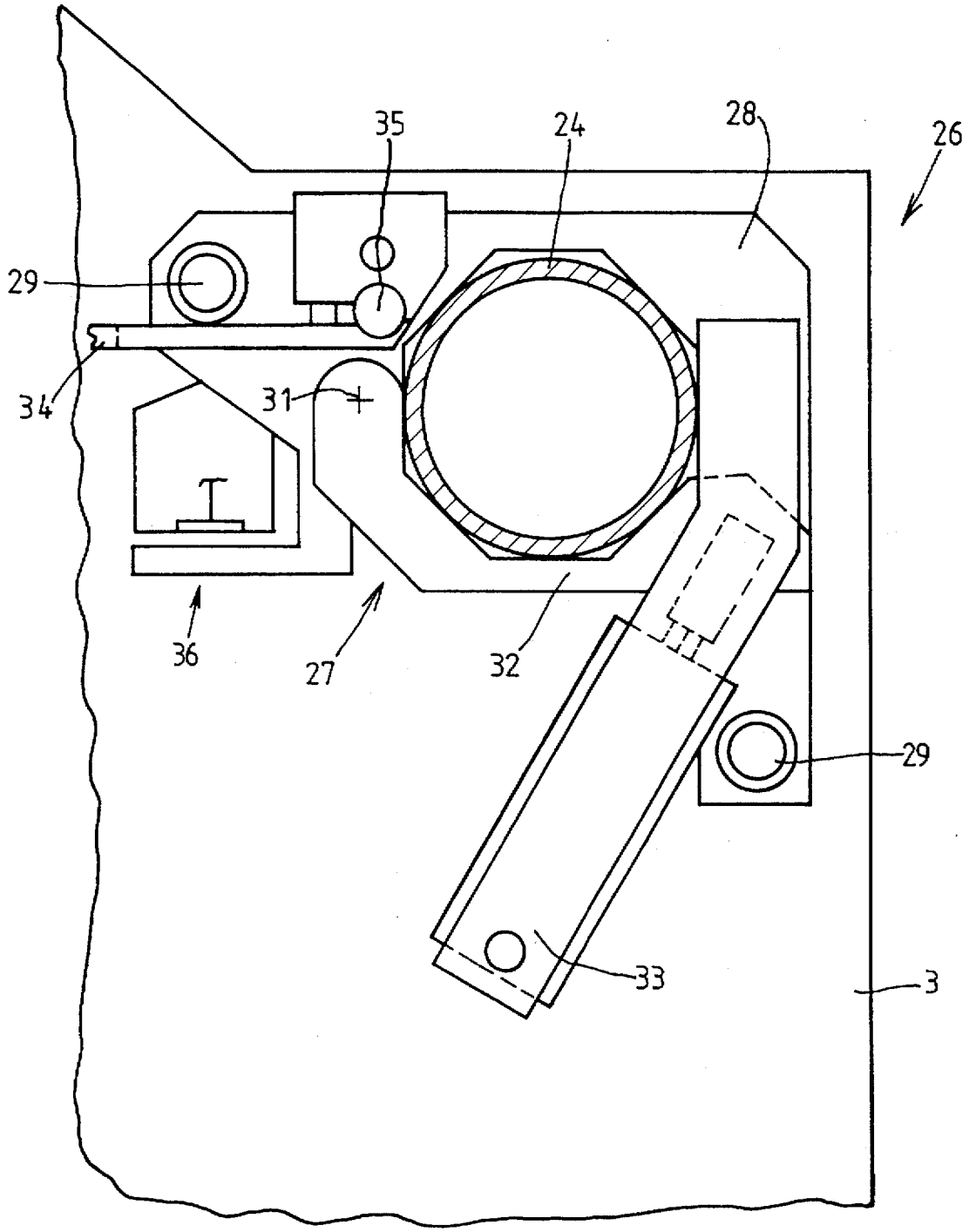
FIG. 4 is a side view, partially in section, of the travel limiting device of FIG. 3 taken along line IV—IV of FIG. 3.

The travel limiting device 26 in accordance with the present invention, which is represented in more detail in FIGS. 3 and 4, essentially consists of a clamp arrangement 27 that is seated, axially displaceable, on slide rails 29 and that includes a clamp chassis 28 and a pneumatically controllable, displaceably seated clamp arm 32 which is rotatable about axis 31 fastened on the clamp chassis 28, and can be acted upon by a pneumatic cylinder 33. The clamp arrangement 27 is positioned in an initial position by spring elements 30 disposed on the guide rails 29. When the yarn engaging device 4 is at a first predefined position with respect to the winding station housing 48, i.e., preferably when stop 23 abuts against housing 48, by actuating cylinder 33, the clamp arrangement 27 is fixed on the braking tube 24 which, in turn, is fixedly connected to the yarn engaging device 4 as described above. An adjustable stop element 35 is furthermore fixed on a bracket 34 on the housing wall element 3 of the doffer 50 and limits the axial travel S of the clamp arrangement 27 to a second predefined position with respect to the respective winding station housing 48, which subsequently is decisive for the positioning of the initial winding to be produced on the empty tube. A Hall sensor 36 is preferably disposed in the area of the travel limiting device 26 for monitoring of the arrival of the clamp arrangement 27 at the second predefined position.

The operation of the yarn engaging device 4 and travel limiting device 26 will now be described in detail.

Figure 5:
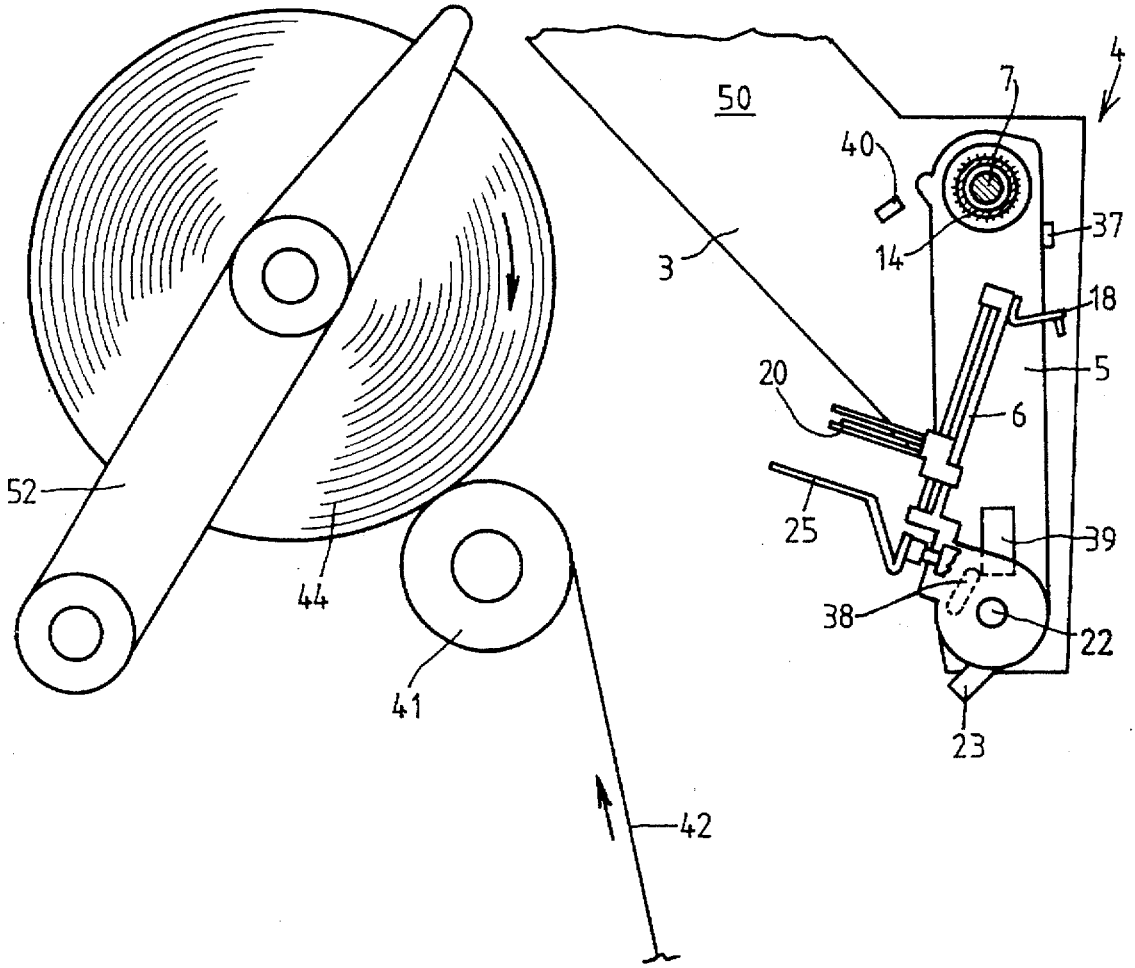
FIG. 5 is a side view of a working position of the yarn positioning mechanism during a doffing and restarting operation.

The initial position of the yarn engaging device 4 is represented in FIG. 5. The pivot housing 5 of the yarn engaging device 4 is in its initial position when it rests against a stop 37 which is disposed, for example, on the housing wall 2 of the doffer 50. The yarn lifter head 6 is also in its initial position with stop 38 abutting a stop element 39 of the pivot housing 5. The clamping shears 20 moreover are open.

Figure 6:
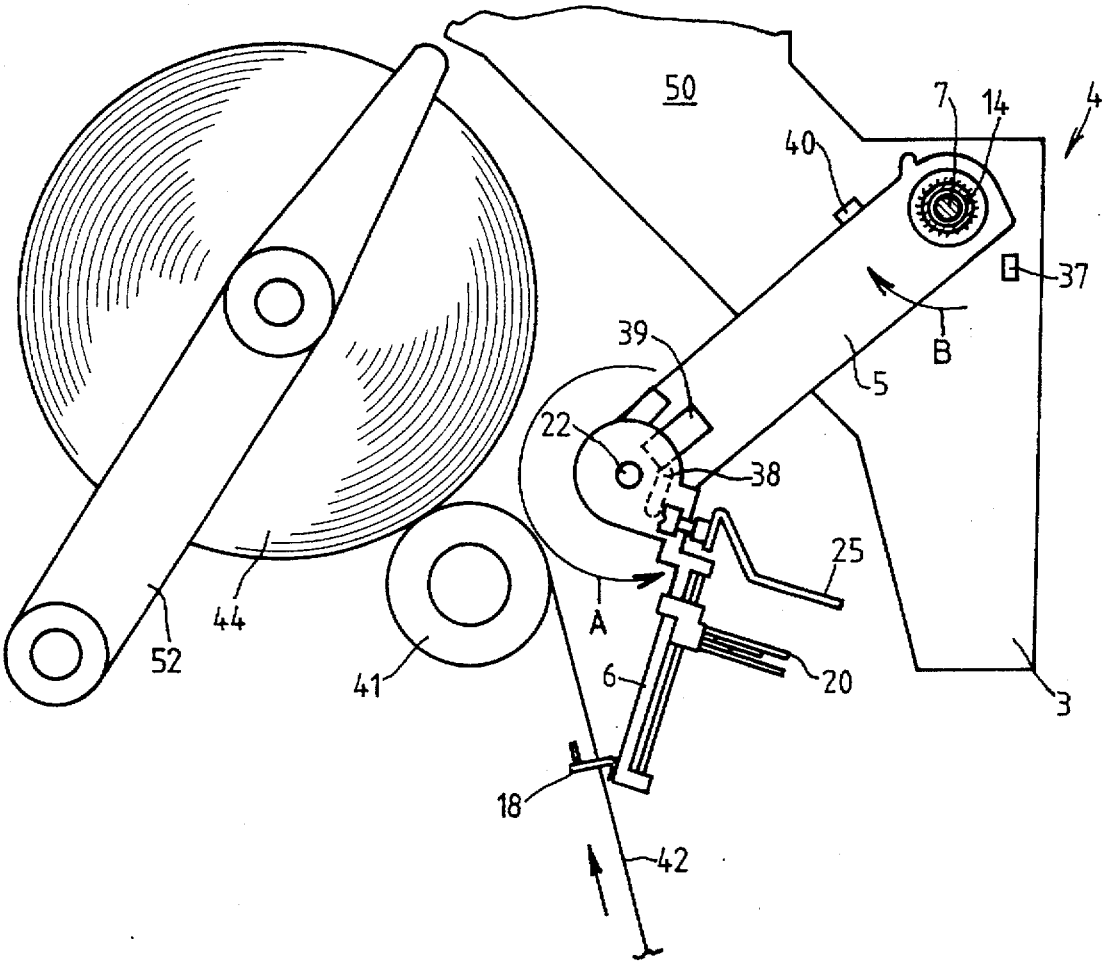
FIG. 6 is a side view of a working position of the yarn positioning mechanism during a doffing and restarting operation.

In the first step, illustrated in FIG. 6, the yarn lifter head 6 is rotated downward in the direction of the arrow A by means of the cam disk drive 8 and the toothed belt drive 12 (see FIG. 1) until the adjustable stop 38 again abuts stop element 39 on its opposite side. The pivot housing 5 is simultaneously pivoted forward in the direction of the arrow B via the cam disk drive 17 (see FIG. 1) until it abuts a stop 40, which is also preferably disposed in the housing wall 2. In this position, the yarn catcher plate 18 is positioned below the yarn guide drum 41 in the area of the traversing yarn 42 and the yarn engaging device 4 thereby catches the traversing yarn 42.

Figure 7:
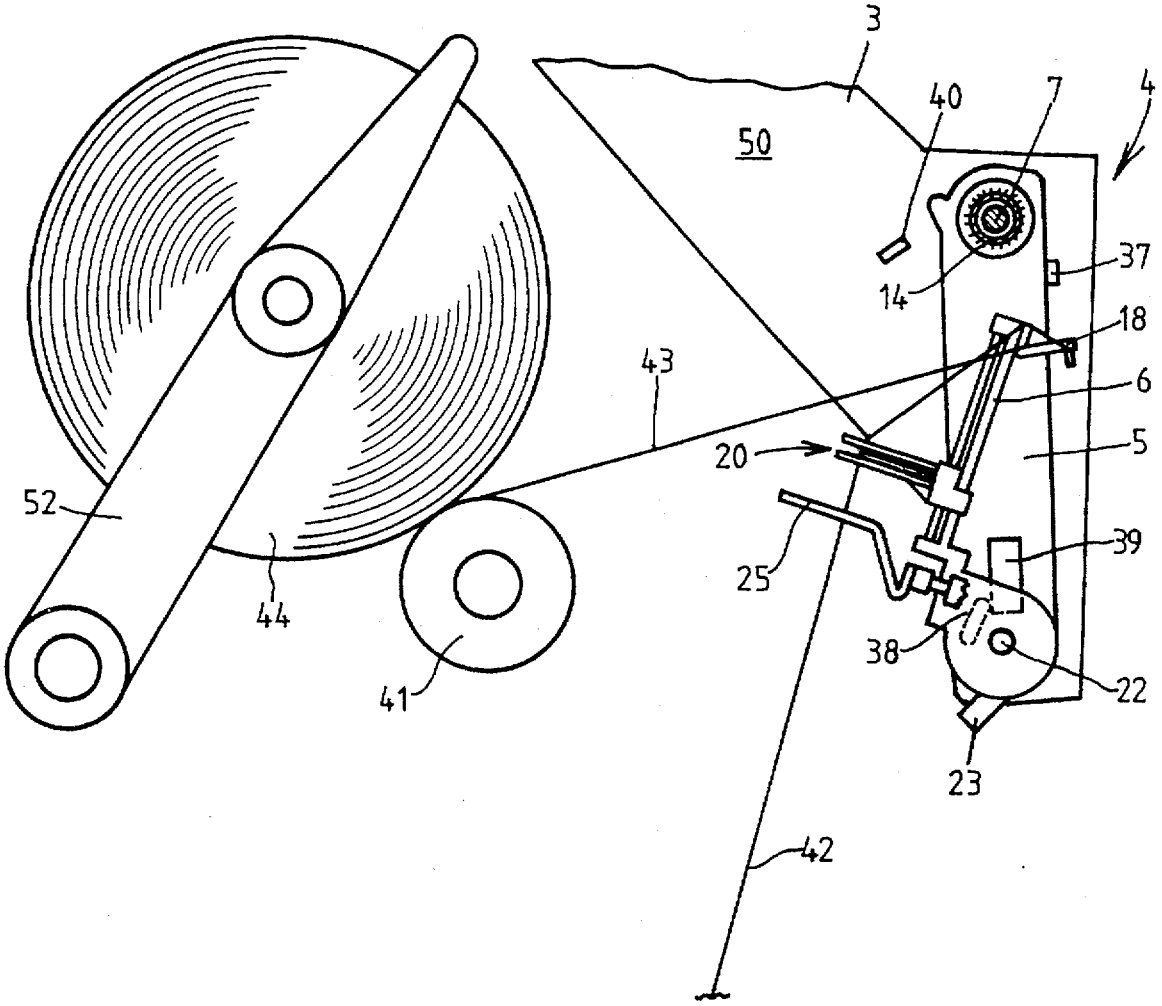
FIG. 7 is a side view of a working position of the yarn positioning mechanism during a doffing and restarting operation.
Figure 8:
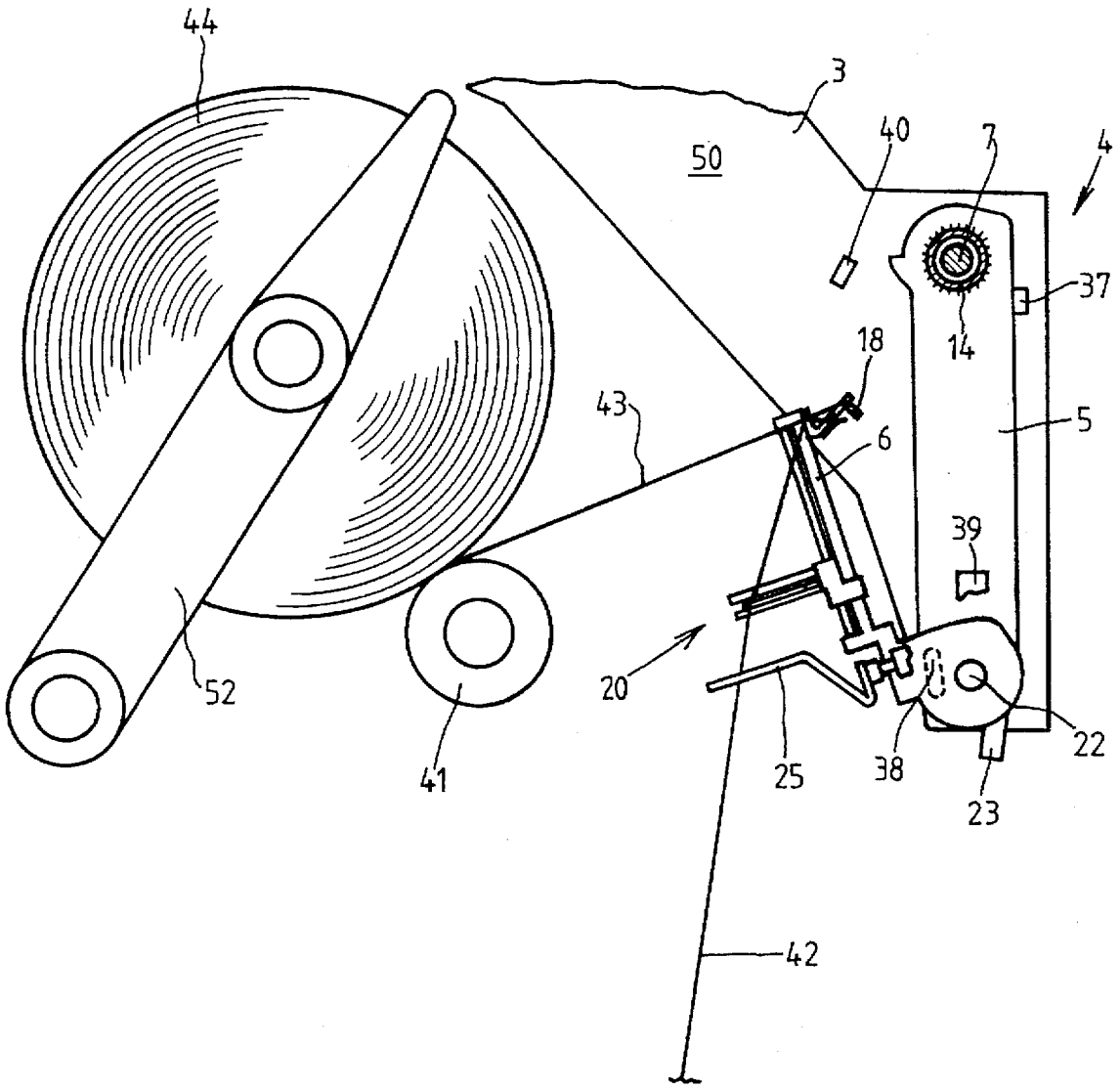
FIG. 8 is a side view of a working position of the yarn positioning mechanism during a doffing and restarting operation.

In the next step the yarn lifter head 6 and the pivot housing 5 are pivoted back into the initial position, as illustrated in FIG. 7. In the process the yarn 42 caught by the yarn catcher plate 18 is threaded into the yarn guide plate 25 and the opened clamping shears 20. Preferably, both the yarn lifter head 6 and the pivot housing 5 are rotated until each again abuts stop elements 39,37, respectively. However, it is contemplated that the yarn engaging device 4 need not be returned to the initial position, but rather, as illustrated in FIG. 8, the yarn lifter head 6 can be selectively stopped at a selected pivot angle to the winding station in order to keep the top yarn 43 slightly shorter.

The top yarn 43 is then displaced in the direction of the tube tip by an appropriate working element (not shown) in a conventional manner to form the end winding on the full package. If appropriate, the top yarn may be briefly moved off the surface of the package and back on again in a conventional manner as taught by and described in German Patent Publication DE 40 40 552 C2.

Figure 9:
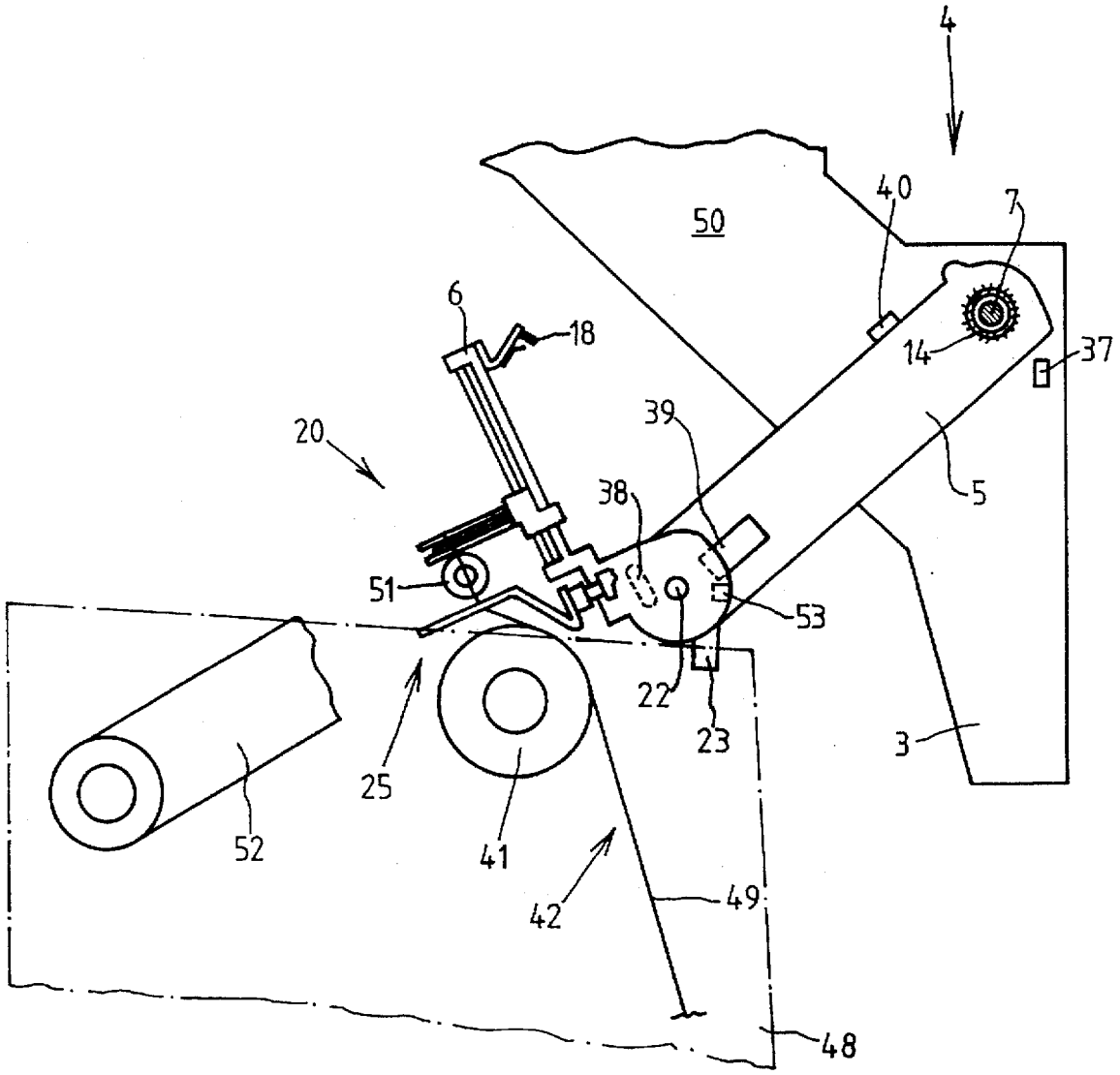
FIG. 9 is a side view of a working position of the yarn positioning mechanism during a doffing and restarting operation.

After the yarn 42 has been cut and clamped by the clamping shears 20, after the top yarn 43 has been wound as the end winding, and after the full package has been conventionally transferred toward a conventional conveyor belt (not shown), the pivot housing 5 pivots into its front position again to abut stop 40, as shown FIG. 9. A stop 53 is also extendible by pneumatic cylinder 53 to engage stop 39 on the pivot housing 5 during pivoting movement of the yarn lifter head 6 as illustrated in FIG. 9. Specifically, cylinder 45 is supported on the yarn lifter head 6 so that it can move axially in a limited fashion during extension thereof, and axial movement of the cylinder 45 during extension thereof causes stop 53 to be extended into position for engagement with stop 39, as illustrated in FIG. 1.

When the yarn lifter head 6 is rotated and extended stop 53 comes into abutment with stop 39, the yarn engaging device 4 is moved by displacement of cam disk 17, as described above, in the direction of arrow 47 towards the direction of the housing wall 3 of the doffer 50 until the stop element 23 abuts the housing wall 48 of the respective winding station at a first predefined location. The yarn end of the yarn 42 identified as the bottom yarn 49 is held by the clamping shears 20 and guided by the yarn guide plate 25 and is positioned in front of the right tube receptacle 51 of the winding frame 52 when the stop element 23 abuts the housing of the winding station 48 at the first predefined location. When the yarn engaging device 4 with the bottom yarn 49 has been moved into its extreme right position, i.e., by a displacement $V_W$, and stop 23 abuts the winding station housing 48, an empty tube is brought between the tube receptacles by means of a conventional tube feeder (not shown), and subsequently the clamp arrangement 27 is clamped to the braking tube 24 of the yarn engaging device 4 by actuation of the pneumatic cylinder 33. Consequently, the clamp arrangement 27 is fixed in place on the braking tube 24 which is connected with the yarn engaging device 4.

The winding frame 52 is then closed and the bottom yarn 49 is clamped between the tube bottom and the tube receptacle 51 of the winding frame. The yarn engaging device 4 is then linearly displaced in a second direction via cam disk 17 opposite to the first direction illustrated by arrow 47. After a defined travel S, the clamp arrangement 27 encounters the adjustable stop 35, schematically represented in FIG. 5–9. Engagement of the clamp arrangement 27 with the stop 35 causes the clamp arrangement to cease further movement, and consequently brakes the travel of the yarn engaging device 4 since the clamp arrangement 27 is attached to the braking tube 24 of the yarn engaging device 4. The travel S performed by the clamp arrangement 27 between its initial position, whereat it clamps to the yarn engaging device 4 at the first predefined position, and its encounter with the stop element 35 at the second predefined location, is decisive for the positioning of the bottom reserve winding which is subsequently produced.

Accordingly, because of the abutment at the second predefined location of the clamp assembly 27 after a travel distance S with a first stop element 35 of the doffer 50, and because of the previous abutment of a second stop element 23 with the winding station housing 48 at the first predefined location from which the travel distance S begins, the position of the yarn engaging device 4 with respect to the winding station housing 48 is precisely defined, regardless of the position of the doffer 50 or the exact installed position of the respective winding station. Thus no conventional adjustments are required for producing a perfect bottom reserve by means of which it might have been necessary, for example, to compensate for assembly-related inexactness during the installation of the winding station.

The doffer embodied in accordance with the present invention preferably is a service unit, particularly in connection with automatic textile winders and, in particular, it completes yarn packages and subsequently exchanges them for empty tubes.

However, within the scope of the invention it is also possible for the doffer designed in accordance with the present invention to be a part of a service unit such as is known from open-end spinning machines. In this case the service unit has, besides the elements of the present invention, further service devices which allow, for example, cleaning of the spinning element and joining the yarn after a yarn break.

In sum, as will be apparent to one of ordinary skill in the art, an advantage of the present invention over the prior art is that the present invention makes it possible to continually produce a precise and accurate initial reserve winding at each winding station without it being first necessary to perform elaborate adjustment operations at each winding station, like, for example, compensating for assembly-related positional deviations at the individual winding stations.

The preferred embodiment of the present invention furthermore represents a rugged design having a long service life.

A further advantage of the preferred embodiment of the present invention described is that in the course of the return pivot of the yarn lifter head the yarn to be manipulated is automatically threaded into the clamping shears disposed on the yarn lifter head and is ready there for further yarn processing steps, such as producing the top winding and the placement of the bottom winding on the fresh empty tube to be exchanged. Moreover, the axial displaceability of the yarn engaging device makes it possible to place the supply yarn held in the clamping shears directly on the empty tube inserted into the winding frame, i.e., to produce a bottom winding at the empty tube while the empty tube is held in the winding frame which is in its position slightly above the winding position. Moreover, because of the preferred catching contours disposed on both sides of the yarn catcher plate, the traversing yarn can be dependably and quickly caught and therefore securely aligned within the clamping shears during pivoting of the yarn lifter head.

The preferred feature of the clamping shears being displaceable on the yarn lifter head and the yarn lifter head being capable of stopping at different pivoting angles from the winding station also makes it possible to match the position of the clamping shears exactly to different tubes. In this way it is possible, for example, to keep the yarn end created during the placement of the supply yarn as short as possible and in this way to avoid the formation of floating yarn or over winding of the yarn end to the greatest extent possible.

The preferred pivoting arrangement for the yarn lifter head, i.e., the pivot and beating shaft, the tooth belt drive, and force transfer mechanism, furthermore permits the pivoting of the yarn lifter head without interference with the axial mobility of the yarn engaging device.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn positioning mechanism of an automatic traveling package doffer that travels along stations of a yarn processing machine, doffs full wound packages, places empty tubes for winding yarn, and positions a supply yarn on the empty tube for winding thereon, comprising:

a doffer housing that travels along the stations of a yarn processing machine, a yarn engaging device movably mounted on said doffer housing for movement relative to said doffer housing in opposite directions parallel to the travel path of said doffer housing and engageable with the end of a supply yarn for positioning the yarn on an empty tube at one of the stations, a travel limiting device mounted on said doffer housing including a clamp assembly and clampable to the yarn engaging device when said yarn engaging device is at a first predefined position with respect to said one of the stations and movable relative to said doffer housing in said opposite directions, and a first stop element attached to said doffer housing for engagement of said clamp assembly and said clamped yarn engaging device in a first one of said directions for stopping movement of said clamp assembly and said clamped yarn engaging device at a second predefined position with respect to said one of the stations for precise positioning of the supply yarn for producing a reserve winding on the empty tube.

2. A yarn positioning mechanism in accordance with claim 1, further comprising a second stop element disposed on said yarn engaging device for engagement with said one of the stations during movement of said yarn engaging device in a second one of said directions opposite to said first direction for stopping movement of said yarn engaging device at said first predefined position for clamping by said clamp assembly.

3. A yarn positioning mechanism in accordance with claim 1, further comprising a sensor disposed on said doffer housing for monitoring the proper positioning of said clamped assembly at said second predefined position.

4. A yarn positioning mechanism in accordance with claim 1, wherein said yarn engaging device further includes both a yarn lifter head pivotable toward and away from said one of the stations and a toothed belt drive connected to said yarn lifter head for controlling pivotable movement of said yarn lifter head, and wherein said doffer housing further includes a pivot and bearing shaft and means axially displaceable on said pivot and bearing shaft for connecting said toothed belt drive to said pivot and bearing shaft for controlling pivoting of said yarn lifter head when said pivot and beating shaft rotates.

5. A yarn positioning mechanism in accordance with claim 1, wherein said yarn engaging device further includes a yarn lifter head pivotable toward said one of the stations and wherein said yarn lifter head includes means for catching a yarn and means for cutting the yarn and retaining the supply yarn resulting from the cut of the yarn.

6. A yarn positioning mechanism in accordance with claim 5, wherein said catching means comprises a yarn catcher plate having yarn catching contours disposed on opposite sides thereof for receiving the yarn.

7. A yarn positioning mechanism in accordance with claim 5, wherein said cutting and retaining means comprises clamping shears that are displaceably disposed on said yarn lifter head for selective positioning on said yarn lifter head, and wherein said yarn lifter head is selectively stoppable in said pivotable movement towards and away from said one of the stations.

8. A yarn positioning mechanism in accordance with claim 1, wherein said travel limiting device includes sliding guide rails fixedly attached to said doffer housing and said clamp assembly is slidably disposed on said guide rails, and further includes spring means disposed on said guide rails for positioning said clamp assembly at an initial position with respect to said doffer housing for clamping to said yarn engaging device.

9. A yarn positioning mechanism in accordance with claim 8, wherein said yarn engaging device includes a braking tube and said clamp assembly includes a pivotable clamping arm within which said braking tube extends when said yarn engaging device is at said first predefined position, said clamp assembly further including a cylinder for actuation of said clamping arm for engagement thereof with said braking tube.

10. A yarn positioning mechanism of an automatic traveling package doffer that travels along stations of a yarn processing machine, doffs full wound packages, places empty tubes for winding yarn, and positions a supply yarn on the empty tube for winding thereon, comprising:

a doffer housing that travels along the stations of a yarn processing machine, a yarn engaging device movably mounted on said doffer housing for movement relative to said doffer housing in opposite directions parallel to the travel path of said doffer housing and engageable with the end of a supply yarn for positioning the yarn on an empty tube at one of the winding stations, and travel limiting means for stopping movement of said yarn engaging device at a predefined position with respect to the one of the winding stations for precise positioning of a supply yarn for producing a reserve winding on the empty tube.

* * * * *